United States Patent [19]

Cravens

[11] 4,133,430

[45] Jan. 9, 1979

[54] CARTONIZED TRAY

[76] Inventor: Harold E. Cravens, 6521 Winston Dr., Woodridge, Ill. 60515

[21] Appl. No.: 849,339

[22] Filed: Nov. 7, 1977

[51] Int. Cl.[2] ..... B65D 65/14

[52] U.S. Cl. ..... 206/497; 229/23 BT; 229/34 R; 229/43; 229/DIG. 12

[58] Field of Search ..... 229/23 R, 23 BT, 34 R, 229/43, DIG. 12; 206/497, 460, 495

[56] References Cited

U.S. PATENT DOCUMENTS

| | | | |
|---|---|---|---|
| 2,827,222 | 3/1958 | Buttery | 229/23 R |
| 2,917,219 | 12/1959 | Schimel | 229/43 |
| 2,936,941 | 5/1960 | Lewis | 229/23 BT |
| 3,531,041 | 9/1970 | Rohde | 229/34 R |
| 3,721,381 | 3/1973 | Locke | 229/23 R |
| 3,901,432 | 8/1975 | Lancaster | 229/23 BT |
| 3,946,870 | 3/1976 | Gajer et al. | 206/497 |
| 3,987,897 | 10/1976 | Smith | 206/497 |
| 4,053,100 | 10/1977 | Baptist | 229/34 R |

*Primary Examiner*—William Price
*Assistant Examiner*—Bruce H. Bernstein
*Attorney, Agent, or Firm*—Hill, Gross, Simpson, Van Santen, Steadman, Chiara & Simpson

[57] ABSTRACT

A two-part container for shipping miscellaneous parts and articles or items as from a catalog outlet or central warehouse has its own lower, shallow tray in which the items are collected. The tray and items therein then pass to a plastic film overlay machine which stretches plastic film under air pressure and heat over the items and adheres it to a bonding coating on inner surfaces of the tray. A top cover is fitted to the tray with lower edges of two side walls thereof abutting the bottom panel of the tray inwardly of the walls thereof. Two end walls of the top cover remain outside the tray and are fastened to the end walls of the tray as by staples or to the bottom of the tray as by tape segments.

8 Claims, 12 Drawing Figures

Fig. 3
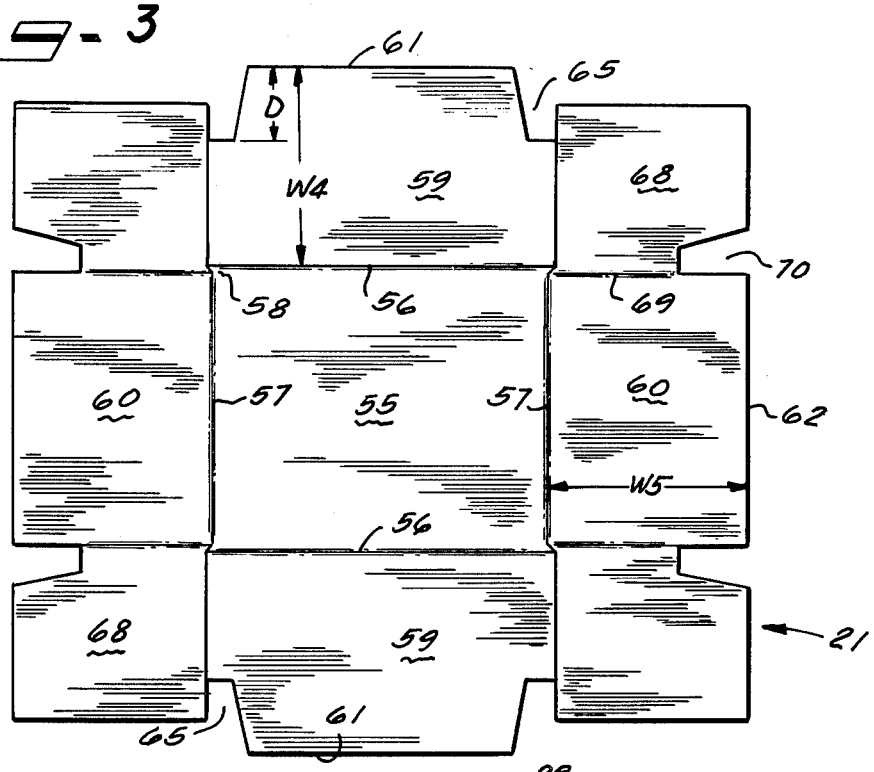
Fig. 1
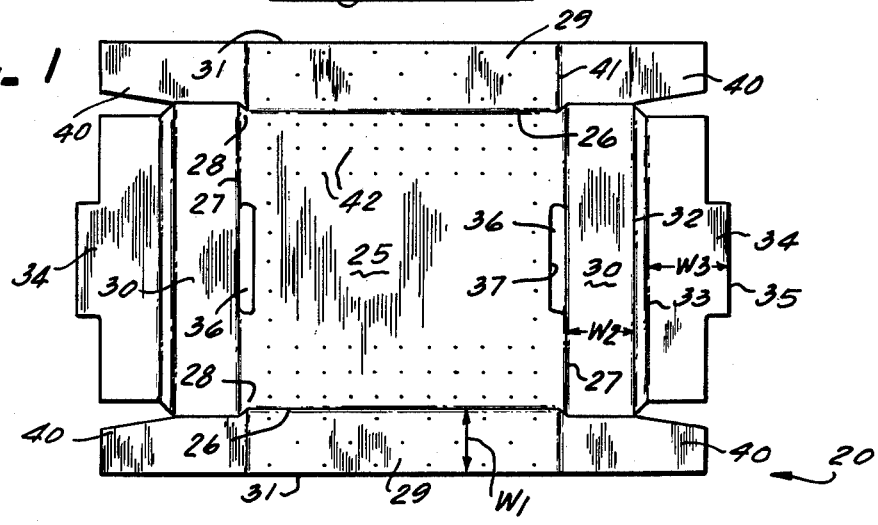
Fig. 4
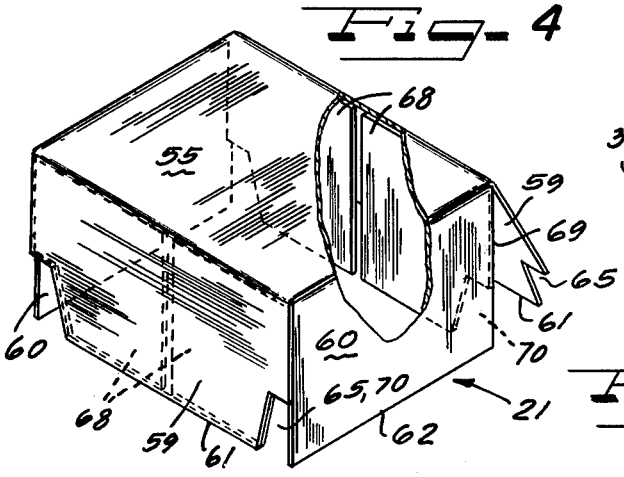
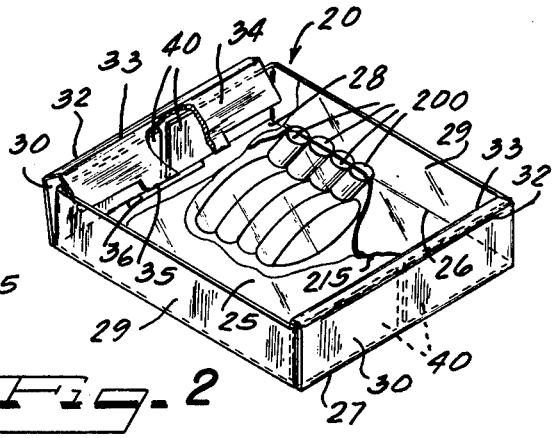
Fig. 2

Fig. 6
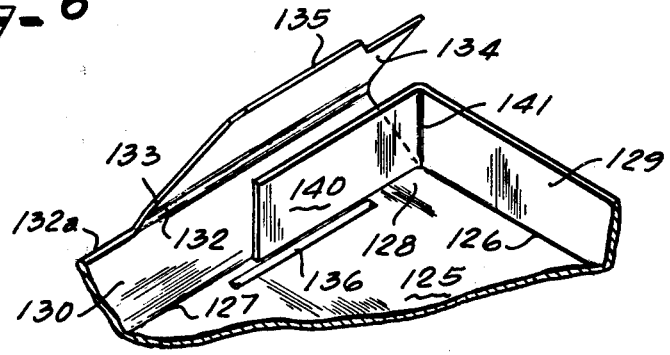
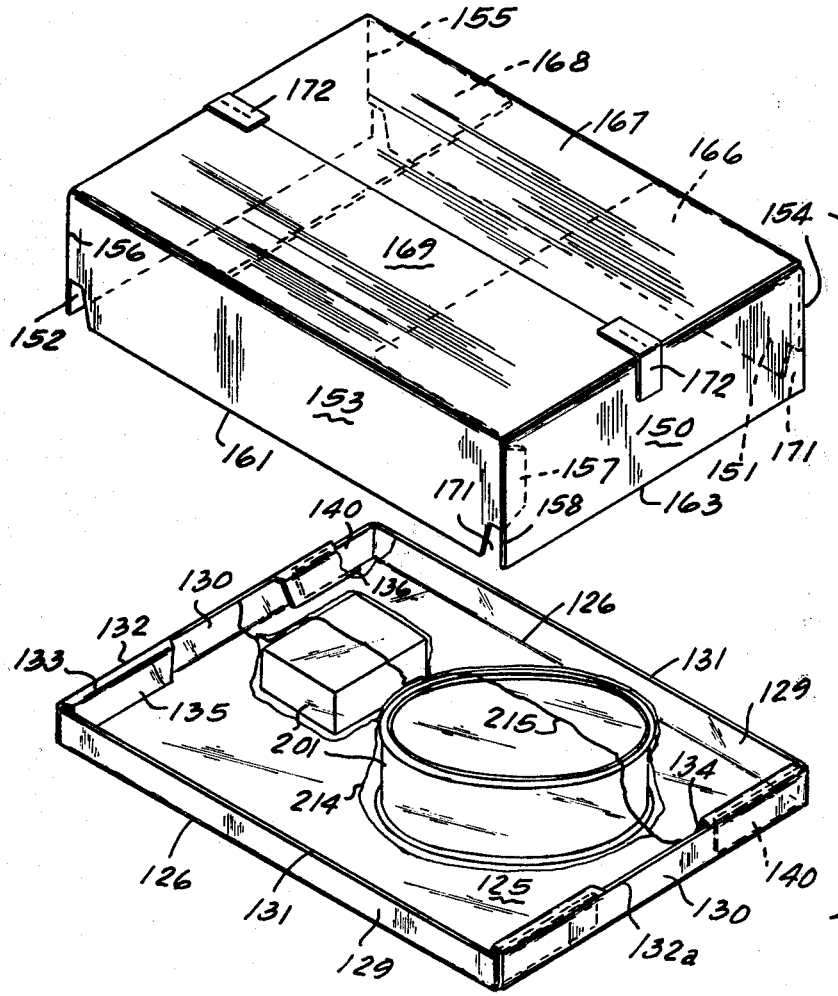
Fig. 9

CARTONIZED TRAY

BACKGROUND OF THE INVENTION

1. Field of the Invention

The present invention relates to cartons and trays used for collecting, packing, and shipping articles in commerce, the cartons and trays being formed from sheet-form members for erection upon need.

2. The Prior Art

Collecting various items of merchandise from available stock according to incoming orders and packaging them for shipment has been a major activity for many businesses. In a typical warehousing operation, whose size and volume does not permit automation beyond such tasks as inventory control, reusable trays are carried by hand among the different storage areas and filled with desired numbers of selected articles. When the order is completed on each tray, the tray is sent to a repackaging station for unloading the articles and packing them with desired cushioning materials in rigid boxes for shipment. Rehandling of the items is costly. Further, even the reasonably careful packager can miss items in the tray or fail to pack them with proper cushioning among the different articles.

Use of skin packaging films such as polyethylene or Surlynbrand films are well known to the art, including drawing a vacuum through a paper-board material onto a resin coating such as Dupont Surlyn-D on the material. Packaging the plastic film with a string captured therein is patented by the American Packaging Company, of Hudson, Ohio. Such skin packaging arrangements are thoroughly automated and mechanized and are now well known to the art.

SUMMARY OF THE INVENTION

The present invention eliminates the need for costly repackaging labor and also improves the effectiveness of the protection the package entering shipment affords the goods therein. A two-part container for both receiving or sorting and shipping miscellaneous items comprises a lower tray having upstanding walls and a bottom panel all coated on inner surfaces thereof with a bonding resin such as Dupont Surlyn-D. The tray is passed among the warehouse shelves to receive selected items and then directly to a plastic overlay station where vacuum and heat are applied to stretch a plastic skin-packaging film over the items and to adhere it to the resin coating of the tray. A cover is then erected and placed over the tray with side walls placed inside the tray and end walls thereof placed outside the tray. Corners of the tray walls pass through notches in the side walls of the cover to interlock with the wall elements of the cover to space the tray bottom and cover top panels apart for protecting the items during shipment. Fastening means such as staples or adhesive tape lock the parts in assembly.

THE DRAWINGS

FIG. 1 is a top plan view of a blank for forming one embodiment of the tray of the invention.

FIG. 2 is a perspective view of an assembled tray in accordance with the invention, with parts broken away for clarity.

FIG. 3 is a bottom plan view of a cover blank for the first embodiment of the cover.

FIG. 4 is a perspective view, partly broken away, of the assembled blank of FIG. 3.

FIG. 6 is a perspective view of one corner of the tray, showing an assembly detail thereof.

FIG. 9 is a perspective view of an assembled cover from FIG. 8 and tray of FIGS. 5–7 in position for final assembly.

THE PREFERRED EMBODIMENTS

Figure 11:
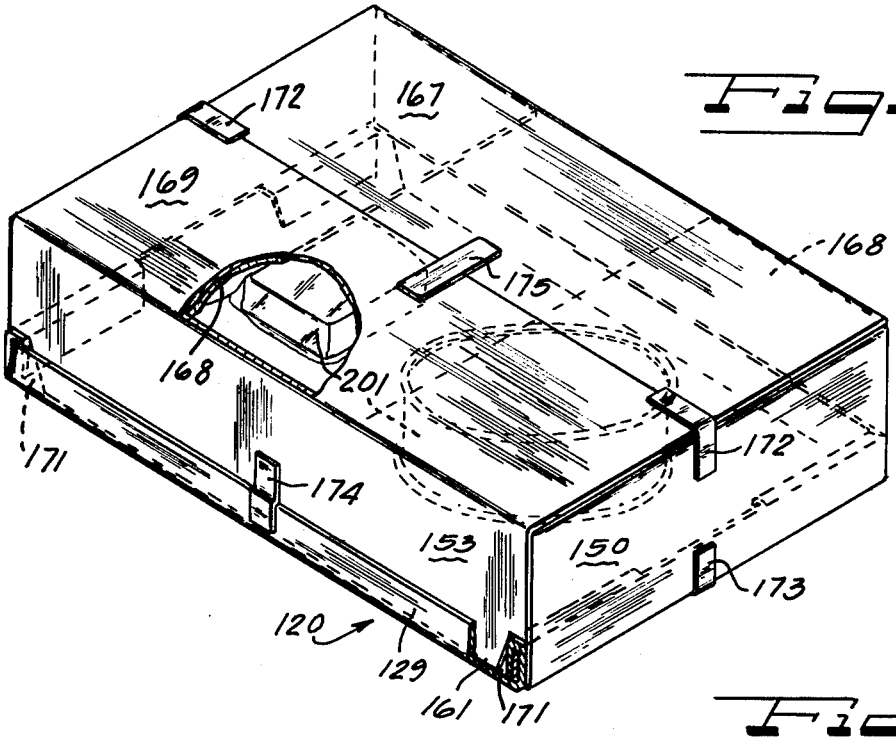
FIG. 11 is a perspective view, partly broken away, of a tray with articles skin-packaged thereto and a cover applied thereover in accordance with the invention.

A first embodiment of a tray and cover therefore is shown in FIGS. 1 through 4 of the drawings. A corrugated, sheet-form material is cut and scored to form a tray blank 20 as in FIG. 1 and a cover blank 21, as in FIG. 3.

The tray blank 20 comprises a rectangular bottom panel 25 having opposite side edges 26 and end edges 27 defined by edge fold lines comprising for instance alternating, spaced perforations extending through all layers of the material of the blank 20 and scores along such edges, and the edge fold lines joining at corners 28 of the bottom panel 25. Side walls 29 are joined to the bottom panel at the side edges 26, and end walls 30 are joined to the bottom panel at the end edge lines 27. Upper edges 31 of the side walls 29 extend parallel to the bottom panel surface 25 and their respective side edges 26, being spaced from the side edges by a width dimension $W_1$ transverse to the side edges.

Each end wall 30 terminates outwardly of the bottom panel end edges 27 at a fold line 32 spaced a distance $W_2$ from the end edge, the distance $W_2$ being substantially equal to the width $W_1$ of the side wall 29. A second fold line 33 is spaced at least one and preferably two thicknesses of the corrugated material away from and parallel to the first fold line 32, and joins a locking tab 34 to each of the end walls 30. Each locking tab 34 extends to a free edge 35 which is spaced a distance $W_3$ from the second fold line 33. The free edge 35 of the locking tab 34 has a linear extent parallel to the end edge 27 of the bottom panel 25 substantially equal to the length of a recess or aperture 36 formed in the bottom panel 25 either by parallel knife cuts or as rectangular voids formed through the material and also extending parallel to the end edge 27. The recess 36 receives the free edge 35 of the locking tab 34 upon folding of locking tab 34 into upstanding relation to the bottom panel 25. An inwardmost wall 37 of the recess or aperture 36 is spaced approximately two and one-half thicknesses of material of the blank 20 away from the end edge 27.

Cooperating with the end walls 30 and the locking tabs 34 are end flaps 40 foldably joined to the side walls 29 at end flap fold lines 41 on each end of the side walls 29. Each end flap 40 has a length parallel to the side edge fold line sufficient to engage beneath the locking tab 34 and to retain the side walls 29 in interlocked engagement with the end walls 30 and locking tabs 34 adjacent the corners 28 of the bottom panel 25.

The entire upper surface of the tray blank 20 is coated with a resin material such as Dupont Surlyn-D or other similar bonding agent for bonding to a selected skin packaging plastic film upon addition of suitable heat and pressure between the plastic film and the bonding agent. The upper surface of the tray blank 20 may also be apertured as at 42 in any regular or other pattern over the bottom panel 25 and side walls 29, to facilitate drawing a vacuum through the corrugated material in the skin film packaging process.

The cover blank 21 in the first embodiment has a top panel structure 55 having side edges 56 and end edges 57 formed by edge fold lines which come together at corners 58 of the panel structure 55. Side walls 59 are joined to the top panel structure 55 at the side edges 56, and end walls 60 are joined to the top panel structure 55 at the end edges 57. The side walls 59 terminate in bottom edges 61 which extend parallel to the side edge fold lines 56. Each side wall 59 has a width $W_4$ in the direction transverse to the side edge 56 which is larger than the corresponding width $W_1$ of the side walls 29 of the tray 20. Each end wall 60 has a free edge 62 also extending parallel to the respective end edge 57 to a width $W_5$ which is substantially equal to the width $W_4$ of the side walls 59.

In accordance with the principles of the invention, the side walls 59 are formed with notches 65 therein having a depth D inwardly from the bottom wall 61, such depth D being at least equal to the height of width $W_1$ of the side walls 29 and the height or width $W_2$ of the end walls 30 of the tray 20. Each notch 65 is formed at an outer corner of the side wall 59 to clear the tray side and end wall structures. Each end wall 60 is formed with an end flap 68 thereon and attached thereto along a fold line 69. A notch 70 is cut from the end flaps 68 to coincide with the notches 65 in the side walls 59 in the folded or assembled position of the cover 21.

In order that the cover 21 fit the tray 20, the top panel structure 55 is substantially the same size and shape as the bottom panel 25, except the end edges 57 may be somewhat narrower and the side edges 56 somewhat longer than the corresponding end and side edges 27, 26 of the tray. Then the side walls 59 of the cover 21 may be received in assembled relation within the side walls 29 of the tray 20, the interlocking corners of the side walls 29 and the end walls 30 of the tray passing through the notches 65 in the cover 21 to allow the bottom edges 61 of the side walls 59 of the cover 21 to abut against the bottom panel 25 of the tray 20 for final assembly. The end walls 60 of the cover 21 fit over the outsides of the end walls 30 of the tray 20. Thus the cover and tray are prevented from moving uncontrollably into or about one another, so that articles bonded by the skin film packaging to the bottom panel 25 of the tray 21 will not contact the upper panel structure 55.

Figure 5:
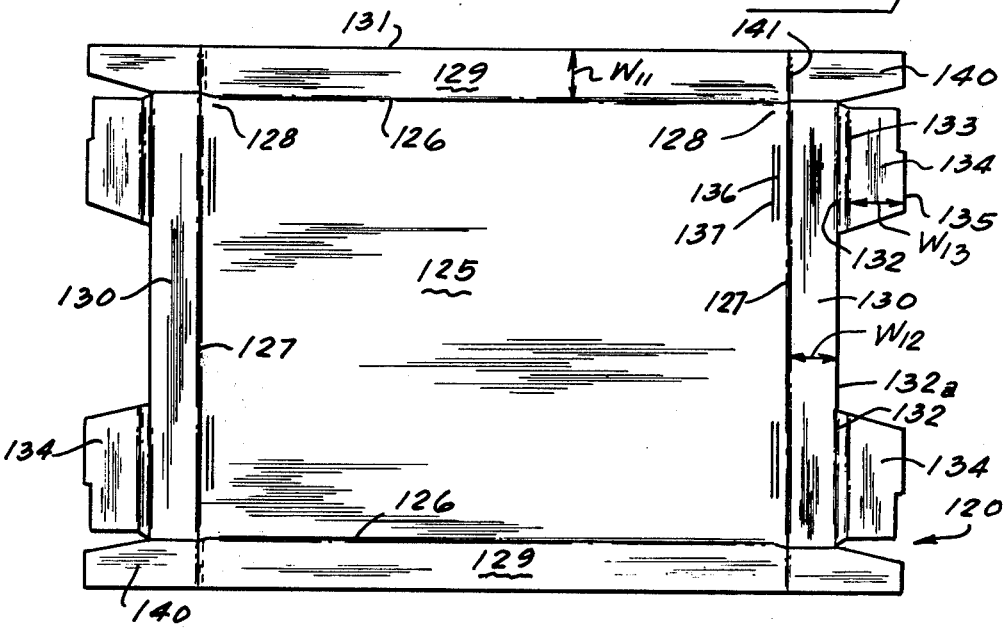
FIG. 5 is a top plan view of a second embodiment of a tray blank in accordance with the invention.
Figure 8:
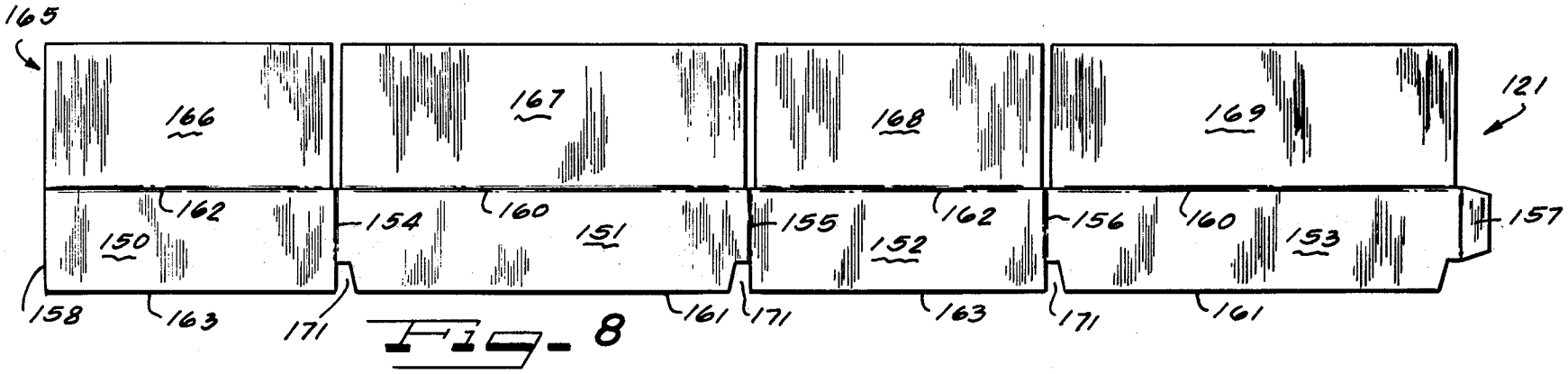
FIG. 8 is a top elevational view of a cover blank usable with the tray of FIG. 5.

In a second embodiment of the invention, a larger size tray 120 is provided as in FIG. 5 and also a correspondingly larger-sized cover 121, as in FIG. 8. The tray 120 comprises a bottom panel 125 of rectangular dimensions, having side edges 126 and end edges 127 joining together at corners 128. Side walls 129 are foldably affixed to the bottom panel 125 along the side edges 126, and end walls 130 are affixed to the bottom panel 125 at the end fold lines 127. The side walls 129 have a width $W_{11}$ transverse to the fold line or side edge 126, and terminate in a free edge 131 as shown.

The end walls 130 may optionally have a free center section edge **132*a* opposite the end edge fold line 127, as shown. Toward each corner 128, however, fold lines 132 and 133 join short locking tabs 134 to the end walls 130. The locking tabs 134 may be joined together across the entire width of the end walls 130 along the edges 132, depending on tray characteristics desired. Each locking tab 134 has a free edge 135 which is engageable in a recess or aperture 136 formed in the bottom panel 125 with an inward edge 137 spaced substantially two thicknesses of material of the blank 120 from the end edge fold line 127. The width $W_{12}$ of the end wall 130 is substantially the same as the width $W_{11}$, while the width $W_{13}$ of the locking tab 134 from the second fold line 133 to the free edge 135 is somewhat greater, to enable the free edge 135 to penetrate into an elongate recess 136 in the bottom panel 125**.

An end flap 140 is affixed to each end of the side walls 129 at fold lines 141. The end flaps 140 are foldable about the fold line 141 to engage and interlock with the end walls 130 at the tray corners 128 by being received between the ends of the end walls 130 and the locking tabs 134 carried thereon.

As in the first embodiment, the entire upper surface of the tray blank 120 is coated with a resin bonding material such as Dupont Surlyn-D, which is adhesive to a skin-packaging film applied thereto with heat and pressure arising from the drawing of the vacuum through the material of the blank 120.

Figure 7:
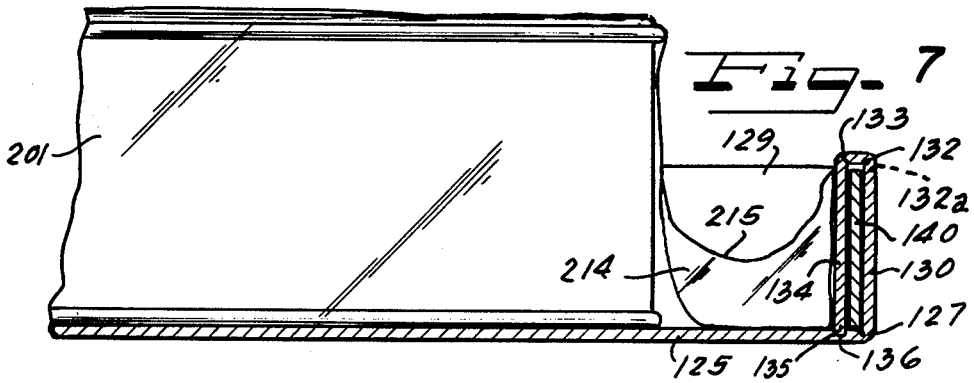
FIG. 7 is a side elevational view of an assembled tray of FIG. 5 with a skin packaging film applied thereto.

Assembly of the blank 120 is shown in detail in FIG. 6, wherein the side walls 129 are folded upwardly on the side edge fold lines 126 and the end flaps 140 are brought inwardly adjacent the aperture 136 in the bottom panel 125. The end wall 130 is folded upwardly about the fold line 127, and the locking tab 135 on each end of the end wall 130 is folded about the lines 132 and 133 to capture the end flap 140 and to engage the free edge 135 of the locking tab 134 into the recess or aperture 136 in the bottom panel 125. In completed configuration, as in FIG. 7, the end of flap 140 is snugly engaged between the end wall 130 outwardly thereof and the locking tab 134 inwardly thereof with respect to the tray 120.

Because of the larger size of the tray of the second embodiment, the cover 121 is made rather differently from the cover 21 of the first embodiment. As shown in FIG. 8, the cover blank 121 comprises four wall panels 150, 151, 152, and 153 connected together sequentially at fold lines 154, 155, and 156 formed in the blank 121. A gluing tab 157 is foldably attached to one end of an endmost one 153 of the wall panels, when required for adhesive attachment to the opposite wall panel 150 inwardly of an end edge 158 thereof, as shown in FIG. 9. The tab 157 is also used when stapling but may be eliminated if a taped joint is to be used.

The walls 151 and 153 comprise side walls of the top cover, having top side edges 160 and parallel bottom side edges 161. The top edges 160 substantially correspond in length to the lengths of the side walls 126 of the tray 120, except the edges 160 may be longer by two thicknesses of material of the tray blank 120 to facilitate interfitting of the cover to the tray by spacing the cover end walls outwardly of the tray end walls 130. The wall panels 150 and 152 comprise end walls of the cover 121, having top end edges 162 and lower end edges 163. The end edges substantially correspond in length to the end edges 127 of the tray blank 120 but may be shorter by the thickness of two thicknesses of the material of the tray blank 120 so that the side walls 151, 153 of the cover will fit between the side walls 129, 129 of the tray.

The top panel structure 165 is formed in four pieces or panels 166, 167, 168, and 169. Each panel is affixed to a respective one of the wall panels 150–153 at the top fold lines 162 and 160. To conserve material, the widths of the top panel structures 166–169, transverse to the top edges, may all be equal at one half the length of an end wall 150 or 152, parallel to the top end edges 162. Of course, each of the top panels 166–169 may extend in width up to the full length of the end walls 150, 152, to provide overlap between the top panels 167, 169. Further, each side wall 151 is formed with a notch 171 therein, extending upwardly from the bottom edge 161 adjoining the fold lines 154 and 155 for the wall panel 151 and 156 and the free edge at the tab 157 for the panel 153. Each notch 171 has a depth transverse to the bottom edge 161 which is at least equal to the height or width $W_{11}$ of the side walls 129 of the tray 120.

In assembly, as shown in FIG. 9, the attachment tab 157 is adhered to the opposite, end wall 150, inwardly of the free edge 158 thereof, the cover 121 may be folded flat at the fold line connecting the tab 157 to the side wall 153 and at the line 155 connecting the side wall 151 to the end wall 152. When the cover is needed for use, additional folds are made at the lines 154 and 156. The top panel members 166 and 168 are folded on the top end edge fold lines 162 downwardly into adjacency with the side walls 151 and 153. Then the remaining top panels 167 and 169 are folded downwardly into engagement with one another and in engagement with the top end panels 166 and 168. The panels 167 and 169 are fastened to one another and to the end walls 150 and 152 by any convenient means such as staples, adhesive, or segments of tape 172.

In use, either the tray blank 20 of the first embodiment or the tray blank 120 of the second embodiment is assembled as needed by folding the side walls 29 or 129 upwardly, and the end flaps 40 or 140 inwardly, and assembling the locking tabs 34 or 134 and end walls 30 or 130 about the end flaps and into engagement with the apertures 36 or 136 in the bottom panel 25 or 125 thereof. The tray as thus assembled is self supporting and will not collapse unless the free ends 35 or 135 of the locking tabs 34 or 134 are forceably removed from the recesses or apertures 36 or 136. As thus assembled, the tray 20 or 120 may be passed manually or on conveyors about the shelves and storage areas of the warehouse and items or articles such as a plurality of purfume bottles 200 or automotive products and maintenance items 201 placed therein according to an order received or a restocking requirement. Generally the items or articles 200, 201 will be one or more of a kind in less than case lots; the even lots are preferably shipped in their own boxes or specially-designed cartons.

Once the order has been filled by placing the appropriate items 200 or 201 in the tray 20 or 120, the tray and contents may be moved along a conveyor 210 and to a skin packaing station 211. The tray 120 there overlies a vacuum suction apparatus 212. A skin packaging head 213 heats a plastic skin-packaging film 214 and applies it over the tray. A film assist mechanism in the head 213 forces the plastic film downwardly near the floor of the tray to be drawn or stretched downwardly over the articles 201 by the vacuum apparatus 212 for bonding to the floor and walls of the tray 120 via the resin coating thereon. The vacuum apparatus 212 draws air directly through the corrugated material of the tray 120 to assure a bond to exposed parts of the tray around and about the items 201. As is known in the art, a severing string 215 may also be applied by the skin packaging head 213 between the articles 201 and the tray 120, the string 215 having an end accessible at the end of the tray 120 for pulling and cutting the plastic sheet 214 when removal of the items 210 is desired.

Figure 10A:
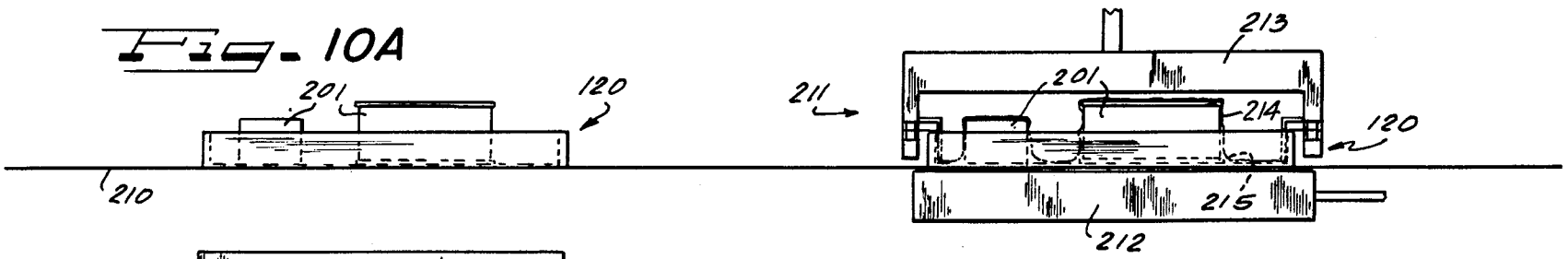
FIG. 10A is a side elevational view of two steps of the method of the invention.
Figure 10B:
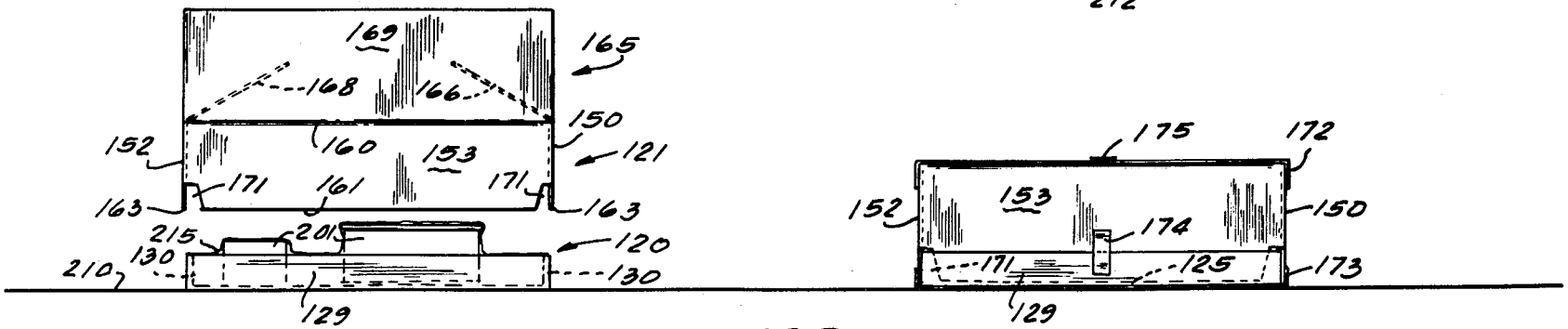
FIG. 10B is a side elevational view of two final steps of the method of the invention.

After application of the skin packaging film 214 at the station 211, the conveyor 210 carries the tray 120 to a covering station as in FIG. 10B, wherein the cover 121 is placed over and within the tray 120 as previously described. That is, the bottom edges 161 of the side walls 153 and 151 are placed inwardly of the side walls 129 of the tray 120, while the bottom edges 163 of the end walls 150 and 152 of the cover 121 remain outwardly of the end walls 130 of the tray 120. The notches 171 pass the corner structures of the tray 120 and of the cover 121 about one another at the corners 128 of the tray without substantial distortion of either.

In a final assembly step, tape segments 172 are applied to secure the top panel structure 165 to the end walls 150, 152. Additional tape segments 173 are applied between the end walls 150 and 152 of the cover 121 and the bottom surface of the bottom panel 125 of the tray 121, as in the right hand side of FIG. 10B. Additional tape segments 174 and 175 may be used to reinforce the centers of the side walls 153 and 129 of the cover 121 and tray 120, respectively, and also the connection between the top panels 167 and 169, as shown. Glue or staples may alternatively be used to attach the cover to the tray. In the completed assembly, shown in FIG. 11, the tray 120 can move neither upwardly into nor away from the cover 121 due to the novel interlocking nature of the side and end walls of the cover 121 with the side and end walls of the tray 120. Thus the items 201 which are contained within the assembled carton and adhered by the skin packaging film to the bottom panel 125 thereof are protected against shocks imposed on the sides, top, and bottom of the carton, yet they are held immobile without rehandling and manual rewrapping of the items 201 in cushioning material. The carton thus may be shipped through the mails or in normal freight with minimum possibilities of damage or loss.

It will be appreciated that the present invention may be practiced in various equivalent forms, including having the end walls of the cover received within the tray and the side walls of the cover placed outside the tray. The notches in the side walls of the cover may be formed in the end walls with only minor resizing of the wall lengths without loss of function. Other materials may be substituted for the corrugated stock material. Although these and various other minor modifications may be suggested by those versed in the art, it should be understood that I wish to embody within the scope of the patent warranted hereon all such modifications as reasonably and properly come within the scope of my contribution to the art.

I claim as my invention:

1. A cartonized tray comprising:

a tray comprising a bottom panel of rectangular shape having opposite side and end edges and an upper surface, upstanding side and end walls engaged with one another adjacent corners of the bottom panel and engaged with the panel at the edges thereof, and a discrete coating of a bonding agent on the inner surfaces of the walls and the upper surface of the panel to make such surfaces adherent to a plastic film; and a cover comprising a top panel structure similar in assembled size and shape to the bottom panel and having corresponding side and end edges, downturned side and end walls engaged with one another at corners of the top panel and with the top panel at fold lines at the side and end edges thereof, the side walls terminating in bottom edges thereof which are parallel to the top panel and at equal distances therefrom, and surfaces forming a notch in each of the side walls through the bottom edges thereof adjoining each end wall, each notch being of a height at least equal to that of the side walls of the tray adjacent the end walls thereof, the notches passing the walls of the tray therethrough without substantial distortion thereof and the tray receiving the side walls of the cover against the bottom panel thereof in abutting relation, whereby miscellaneous items received in the tray may be bonded to the tray by an overlying heat-shrinkable plastic film applied to said coating surfaces of the tray and then enclosed for shipping within the walls and spaced top panel of the cover.

2. A cartonized tray as defined in claim 1, wherein the top panel structure is formed in one piece and the side and end walls are foldably attached to the side and end edges thereof, and wherein the end walls of the cover further comprise a pair of end flaps foldably affixed to either side thereof, each end flap being shaped to underlie the side walls and to leave the notches therein open when folded together.

3. A cartonized tray as defined in claim 1, wherein a pair of separate locking tabs are provided on each end wall of the tray in cooperating relation with a corresponding pair of recesses formed in the bottom panel, the locking tabs engaging portions of the side walls in interlocking relation and leaving a center portion of the end wall and its bonding agent coating exposed for adhering to the plastic film.

4. An article for collecting and packing miscellaneous articles as from a warehouse, comprising:

a shallow tray having a flat bottom and upstanding and interlocked side and end walls for receiving said articles therein;

a skin package film bonded over the tray and articles with application of heat to the plastic and vacuum to the tray;

a tray cover having a top panel and side and end walls downwardly depending therefrom;

surfaces forming a notch in each of the side walls through the bottom edges thereof adjoining each end wall, each notch being of a height at least equal to that of the side walls of the tray adjacent the end walls thereof, lower edges of the side walls of the cover being receivable within the tray in abutting relation to the bottom thereof and lower edges of the end walls being positionable outside the tray; and means engaging the end walls of the cover for securing the cover to the tray for shipment.

5. A cartonized tray comprising:

a tray having a rectangular bottom panel with side and end edges and at least two elongate recesses formed therein each with a wall spaced approximately two thicknesses of the material from the end edge, a pair of side wall panels foldably attached to opposite side edges of the bottom panel, each said side wall panel having a width in the direction transverse to the side edge and a length, a pair of end wall panels foldably attached to the end edges of the bottom panel and having a width transverse to the end edge and a length, each of the end walls having at least one locking tab foldably affixed thereto opposite the end edges of the bottom panel, each locking tab having a width greater than that of the end wall for engaging the recess in the bottom panel after folding double with the end wall, the side walls each having a pair of end flaps attached foldably at each end thereof, each end flap having a width less than that of the side wall and a length sufficient for capture beneath the locking tab of the end wall and the upper surfaces of said tray being coated with a bonding agent adherent to plastic skin-packagfilm; and a cover comprising:

side and end walls and a top cover surface joined foldably one to another, and similar in assembled size and shape to said rectangular bottom panel, the side walls having equal widths transverse to fold lines joining them to the cover surface and bottom edges opposite and parallel to said fold lines, and surfaces forming a notch at each end of each side wall through the bottom edge and having a depth at least equal to the width of the side walls of the tray and a width transverse thereto for passing one of the walls of the tray without substantial distortion of the walls of the tray or cover blanks, whereby miscellaneous items received in the tray may be bonded to the tray by an overlying heat-shrinkable plastic film applied to said coating surfaces of the tray and then enclosed for shipping within the side and end walls and top cover surface of the cover.

6. A two-part blank formed of sheet-form material for assembly into a tray and an interlocking cover for the tray, the two-part blank comprising:

a tray blank having a rectangular bottom panel with side and end edges and at least two elongate recesses formed therein each with a wall spaced approximately two thicknesses of the material from the end edge, a pair of side wall panels foldably attached to opposite side edges of the bottom panel, each said side wall panel having a width in the direction transverse to the side edge and a length, a pair of end wall panels foldably attached to the end edges of the bottom panel and having a width transverse to the end edge and a length, each of the end walls having at least one locking tab foldably affixed thereto opposite the end edges of the bottom panel, each locking tab having a width greater than that of the end wall for engaging the recess in the bottom panel after folding double with the end wall, the side walls each having a pair of end flaps attached foldably at each end thereof, each end flap having a width less than that of the side wall and a length sufficient for capture beneath the locking tab of the end wall upon folding of the tray blank into a tray, and the upper surfaces of the blank being coated with a bonding agent adherent to plastic skin-packaging film; and cover blank comprising:

side end walls and a top cover surface joined foldably one to another, the side walls having equal widths transverse to fold lines joining them to the cover surface and bottom edges opposite and parallel to said fold lines, and surfaces forming a notch at each end of each side wall through the bottom edge and having a depth at least equal to the width of the side walls of the tray blank and a width transverse thereto for passing one of the walls of the tray without substantial distortion of the walls of the tray or cover blanks said cover blank comprising:

a one-piece top cover surface with the end side walls joined to four edges thereof, and said end walls carrying end flaps cooperable with said side walls to interlock the structure upon folding.

7. A two-part blank as defined in claim 6, wherein the locking tabs on the end walls have less surface area than the end walls, whereby the bonding agent on the interior surfaces of the end walls and the end flaps adheres the plastic film also to the inner end surfaces of the tray.

8. A two-part blank as defined in claim 6, wherein:

the locking tabs on the end walls have substantially the same surface area as the end walls, thereby to rigidify the end walls.

* * * * *

UNITED STATES PATENT AND TRADEMARK OFFICE

CERTIFICATE OF CORRECTION

PATENT NO. : 4,133,430

DATED : January 9, 1979

INVENTOR(S) : Harold E. Cravens

It is certified that error appears in the above-identified patent and that said Letters Patent are hereby corrected as shown below:

Column 6, line 6, change the numeral "210" to --201--.

Signed and Sealed this

*Fourteenth* Day of *August 1979*

[SEAL]

*Attest:*

LUTRELLE F. PARKER

*Attesting Officer* *Acting Commissioner of Patents and Trademarks*